US009046007B2

(12) United States Patent
Keli et al.

(10) Patent No.: US 9,046,007 B2
(45) Date of Patent: Jun. 2, 2015

(54) CAMLESS ENGINE OPERATING SYSTEM

(71) Applicants: Jacob B. Keli, Detroit, MI (US); Abbas M. Vuai, Detroit, MI (US)

(72) Inventors: Jacob B. Keli, Detroit, MI (US); Abbas M. Vuai, Detroit, MI (US)

( * ) Notice: Subject to any disclaimer, the term of this patent is extended or adjusted under 35 U.S.C. 154(b) by 0 days.

(21) Appl. No.: 14/091,743

(22) Filed: Nov. 27, 2013

(65) Prior Publication Data

US 2014/0144398 A1 May 29, 2014

Related U.S. Application Data

(60) Provisional application No. 61/730,098, filed on Nov. 27, 2012.

(51) Int. Cl.
*F01L 9/04* (2006.01)

(52) U.S. Cl.
CPC ..... *F01L 9/04* (2013.01); *F01L 2009/0401* (2013.01)

(58) Field of Classification Search
CPC ..... F01L 9/04
USPC ..... 123/90.11
See application file for complete search history.

(56) References Cited

U.S. PATENT DOCUMENTS

| | | | | |
|---|---|---|---|---|
| 1,471,861 | A * | 10/1923 | Perrault | 123/90.11 |
| 4,957,074 | A | 9/1990 | Weissler, II et al. | |
| 5,201,296 | A * | 4/1993 | Wunning et al. | 123/479 |
| 6,810,841 | B1 | 11/2004 | Peterson et al. | |
| 6,928,966 | B1 | 8/2005 | Sun | |
| 7,182,603 | B1 | 2/2007 | Koneda et al. | |
| 7,451,728 | B1 * | 11/2008 | Geer | 123/90.11 |
| RE42,667 | E | 9/2011 | Hammoud et al. | |
| 2002/0069843 | A1 * | 6/2002 | Miller | 123/90.11 |
| 2003/0221421 | A1 | 12/2003 | Gui et al. | |
| 2005/0103290 | A1 | 5/2005 | Magner et al. | |
| 2005/0205026 | A1 | 9/2005 | Flohr | |
| 2005/0263116 | A1 | 12/2005 | Babbitt et al. | |
| 2006/0011157 | A1 | 1/2006 | Flohr | |
| 2006/0070591 | A1 | 4/2006 | Merwin | |
| 2006/0150932 | A1 | 7/2006 | Naber et al. | |
| 2006/0150935 | A1 | 7/2006 | Donaldson | |
| 2008/0041467 | A1 | 2/2008 | Stretch | |
| 2008/0109151 | A1 * | 5/2008 | Jaros et al. | 701/115 |
| 2008/0236525 | A1 | 10/2008 | Babbitt et al. | |
| 2012/0097121 | A1 | 4/2012 | Brennan et al. | |

FOREIGN PATENT DOCUMENTS

| | | |
|---|---|---|
| GB | 2465188 | 5/2010 |

* cited by examiner

*Primary Examiner* — Zelalem Eshete
(74) *Attorney, Agent, or Firm* — Fishman Stewart Yamaguchi PLLC

(57) ABSTRACT

A camless engine operating system that includes an inlet valve switch configured to detect rotational movement of an inlet valve power disc and to output an inlet actuator voltage. A voltage level of the inlet actuator voltage is synchronous with the rotational movement of the inlet valve power disc. An inlet valve is movable to open and close an intake port of a combustion chamber. An inlet valve mechanical force moves the inlet valve to open the intake port. An inlet actuator is configured to exert the inlet valve mechanical force onto the inlet valve. The inlet actuator voltage received by the inlet actuator controls the inlet actuator to exert the inlet valve mechanical force onto the inlet valve.

19 Claims, 13 Drawing Sheets

CAMLESS ENGINE OPERATING SYSTEM

CROSS REFERENCES TO RELATED APPLICATIONS

The present invention claims priority from U.S. Provisional Application No. 61/730,098, filed on Nov. 27, 2012, the entire contents of which being incorporated herein by reference.

BACKGROUND OF THE INVENTION

1. Technical Field

The present invention relates to engines. More specifically, the present invention relates to camless engines and to methods of improving efficiency of engines.

2. Background Art

Internal combustion engines that utilize pistons have been used in automobiles and other motorized devices for many years. Conventional camshafts are used to control the opening of the valves and are driven by a crankshaft. The camshaft is designed to rotate either in the engine block or on the cylinder head to open and close the valves. The camshaft is driven by the crankshaft and the camshaft includes egg-shaped surfaces called cam-lobes to open the valves. The position of the lobe is precise in opening and closing the valves when the shaft rotates. The lobe determines how far the valve opens and the duration it takes to open the valve.

There are several different arrangements of camshafts, such as single overhead cam, double overhead cam, and pushrod. Single overhead cam (SOHC) means that the engine has one cam per head, such as four or six cylinders inline. The double overhead cam (DOHC), such as the V-6 or V-8 engine, has two cams—one for each head. The cam actuates the rocker arms that press down the valves to open the valves. Spring returns the valves to their closed position. At a very high speed, these springs have to be very strong, otherwise the valves might lose contact with the rocker arm. This can result in extra wear and tear on the cams and rocker arms. On the single and double overhead cam engines, the cams are driven by the crankshaft by using a chain (timing chain) or a belt (timing belt). These chains and belts need to be changed regularly as per the engine's maintenance schedule, because if they break, the camshaft stops spinning and the piston will hit the open valve and damage both the piston and the valve as well as other parts. The main reason to use the double overhead cam is to facilitate more air in the cylinder and to expel more exhaust air. The engine thereby gains more power.

In the SOHC and DOHC, valves are located in the head above the cylinder. In a pushrod engine, the camshaft is in the engine block rather than in the head. The long rods add mass to the system, which increases the load on the valve springs. This can limit the speed of the pushrod engine; the overhead camshaft, which eliminates the pushrod from the system, is one of the engine technologies that made higher engine speeds possible. The camshaft in a pushrod engine is often driven by gears or a short chain. Gear-driven camshafts are generally less prone to breaking than belt drives, which are often found in overhead cam engines.

In the typical internal combustion engine, the use of camshafts results in a power loss of the engine of 20%. The conventional design of the internal combustion engine regarding the use of camshafts has not changed in many years. There remains a need for an engine with greater efficiency and a new design of actuating pistons.

SUMMARY OF THE INVENTION

The present invention provides for an electronic actuating mechanism that actuates at least one piston in an engine.

The present invention further provides for a camless engine operating system including an electronic actuating mechanism for actuating at least one piston in the engine and a coordination assembly to energize and control the electronic actuation mechanism.

The present invention also provides for a method of electronically operating an engine, by supplying power to a coordination assembly, energizing the electronic actuation mechanism, and actuating at least one piston in the engine.

DESCRIPTION OF THE DRAWINGS

Other advantages of the present invention are readily appreciated as the same becomes better understood by reference to the following detailed description when considered in connection with the accompanying drawings wherein.

DETAILED DESCRIPTION OF THE INVENTION

Figure 1J:
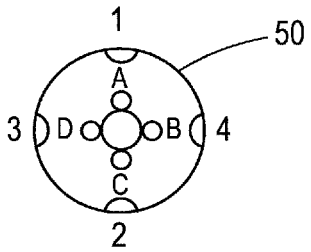
FIG. 1J is a top view of a distributor.

The present invention is generally directed to a camless engine operating system and methods for actuating pistons and valves electronically in any vehicle or device that uses an engine. The camless engine operating system 2 of the present invention can increase the efficiency of the engine over traditional engines by at least 20%. Essentially, the present invention changes the prior mechanical control of the engine to an electronic control. The camless engine operating system 2 allows an engine to be operated without camshafts as compared to standard prior art engines that require a camshaft.

In the preferred embodiment, the camless engine operating system 2 includes least one electronic actuation mechanism 10. As shown in FIGS. 1A and 1B, the electronic actuation mechanism 10 operates at least one inlet valve 18 or at least one exhaust valve 20, and preferably both at least one intake valve 18 and at least one exhaust valve 20. Preferably, the electronic actuation mechanism 10 is a solenoid. The inlet valve 18 being any valve sufficient to block and unblock an intake port in a cylinder 8 is also within the scope of the invention. The exhaust valve 20 being any valve sufficient to block and unblock an exhaust port in a cylinder 8 is also within the scope of the invention.

Alternatively, the electronic actuating mechanism 10 can include motors, pneumatic technology, hydraulics, or any other suitable mechanism that can be used electronically to actuate valves.

Figure 2:
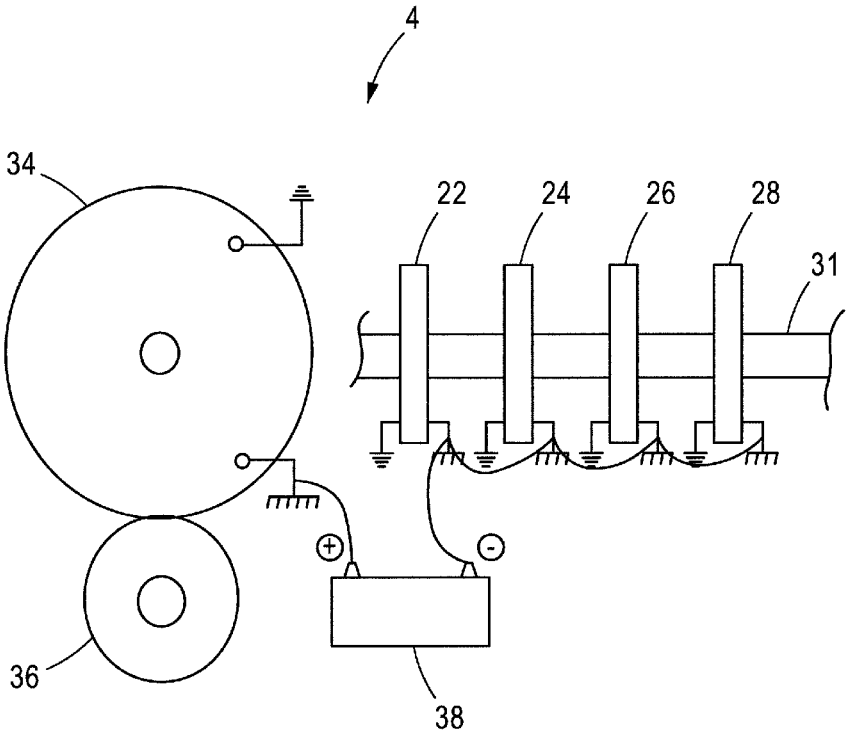
FIG. 2 is a schematic view of a timing wheel supplying power to discs.

Shown at 4 in FIG. 2, the camless engine operating system 2 also includes a coordination assembly 4 to time and synchronize the operation of an inlet valve 18 and an exhaust valve 20 by energizing the at least one electronic actuation mechanism 10 at appropriate points during a combustion cycle. The coordination assembly 4 can also control other aspects of engine operation, such as ignition and fuel injection.

In the preferred embodiment of the camless engine operating system 2, the coordination assembly 4 includes least two rotatable discs; an inlet power disc 22 to energize an electronic actuation mechanism 10 operating the inlet valve 18; and an exhaust power disc 24 to energize an electronic actuation mechanism 10 operating the exhaust valve 20. Preferably the coordination assembly 4 also includes an all-time exhaust power disc 26 to energize an electronic actuation mechanism 10 operating the exhaust valve 20 when the cylinder 8 is not in firing order. The coordination assembly 4 optionally includes an ignition and injection power disc 28 to power spark plugs and injectors (not shown) and a signaling disc 29 to inform an engine control unit 40 and other engine control components of the rotational speed of the discs 22, 24, 26, and 28. The discs 22, 24, 26, 28 and 29 are fixedly mounted coaxially upon a common disc shaft 31.

Mounted upon the disc shaft 31 is a timing wheel 34 to provide torque to rotate the disc shaft 31. The torque is supplied via a connection between the timing wheel 34 and the crankshaft 36 of the engine. The connection between the timing wheel 34 and the crankshaft 36 is mediated by a belt, chain, gear train, frictional contact (not shown), or suitable mechanical linkage known in the art. Preferably, the timing wheel 34 and disc shaft 31 rotate at the same speed as the crankshaft 36.

Figure 6A:
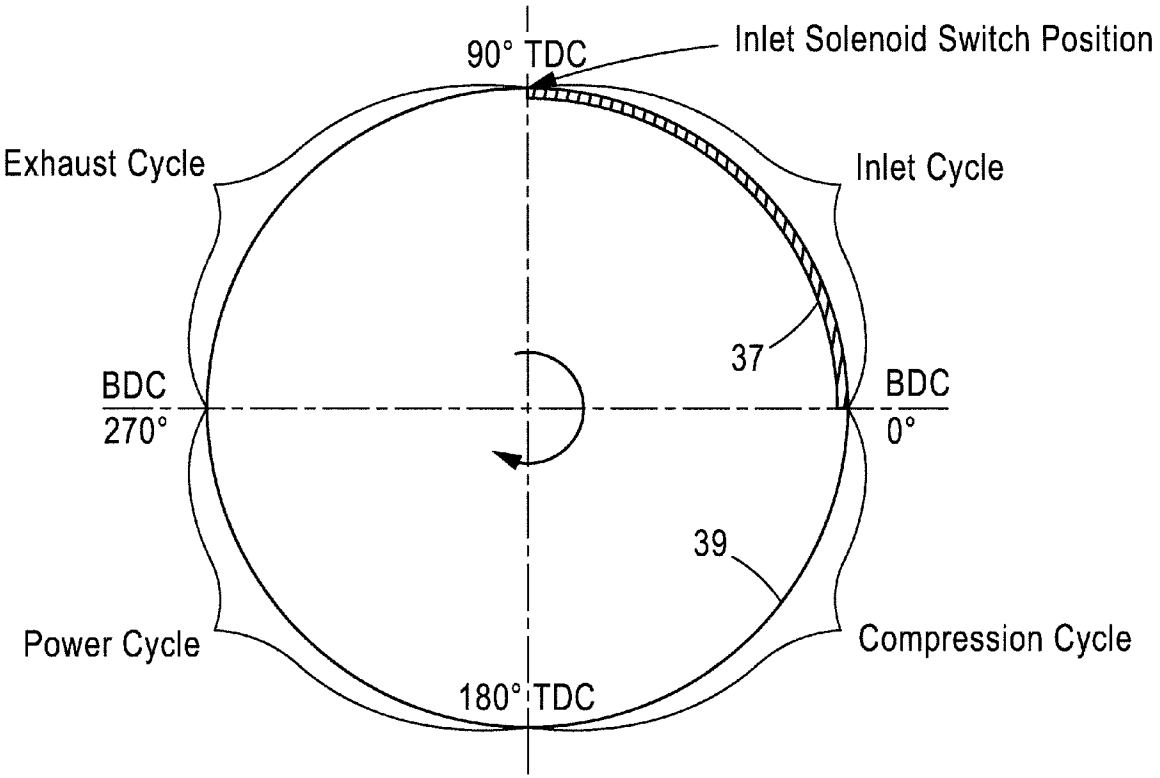
FIGS. 6A and 6B are views of cycles of operation.
Figure 6B:
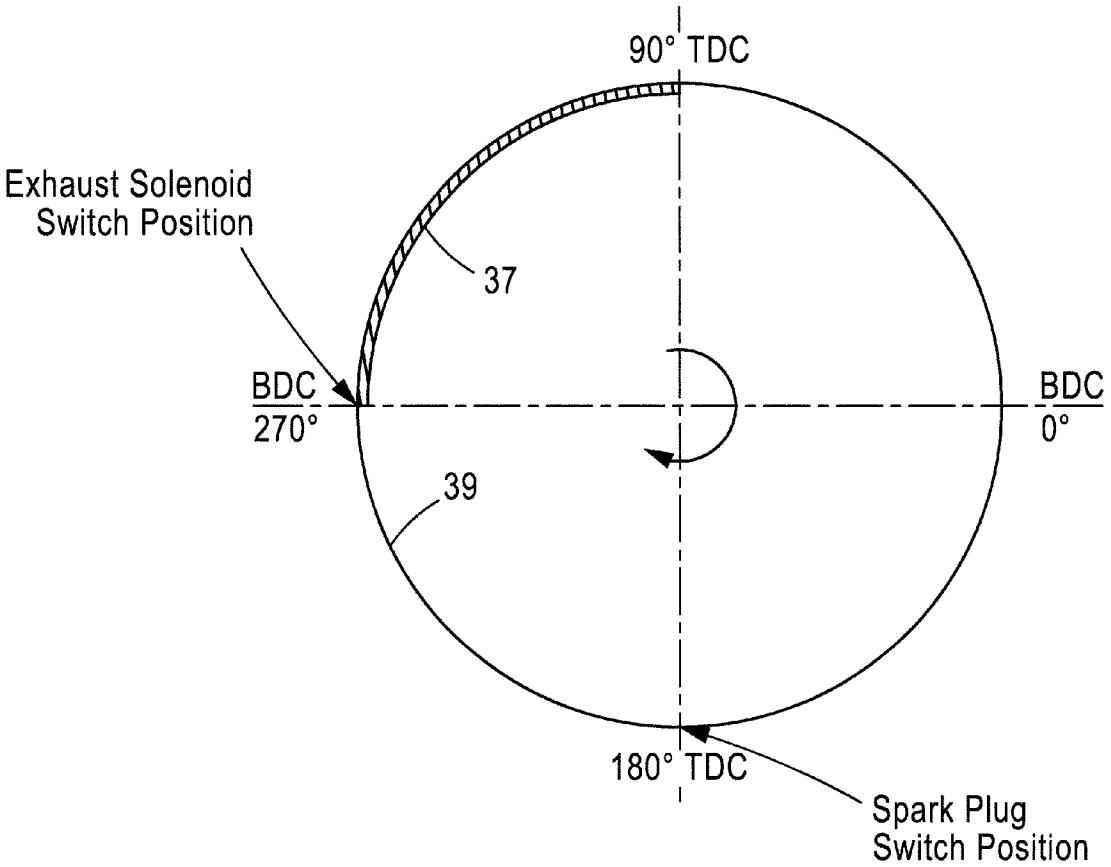

The discs 22, 24, 26, 28, and 29 can be of any appropriate size, and can be, for example, 5 inches diameter and ½ inch thick. Each disc 22, 24, 26, and 28 has cross section that is shown in FIGS. 6A and 6B. As shown in FIGS. 6A and 6B, each disc 22, 24, 26, and 28 includes at least one conductive portion 37 and at least one nonconductive portion 39. The conductive portion 37 is composed of a conductive material, such as, but not limited to, brass or copper. The nonconductive portion 39 is composed of a non-conductive material such as, but not limited to, hard plastic, as shown in an exemplary configuration in FIGS. 6A and 6B. The coordination assembly 4 also includes an inlet valve switch 60 in contact with the inlet valve power disc 22, an exhaust valve switch 62 in contact with the exhaust valve power disc 24, an all-time exhaust valve switch 64 in contact with the all-time exhaust valve power disc 26, and an ignition and injection switch 66 in contact with the ignition and injection power disc 28. The switches 60, 62, 64, and 66 conduct power from a power source, such as a battery 38, via the conductive portion 37 of the respective discs, 22, 24, 26, and 28, to energize an electronic actuation mechanism 10. Each switch 60, 62, 64, and 66 is mounted on any suitable part of the engine to allow it to contact its respective disc 22, 24, 26, and 28. Preferably, the conductive portion 37 is situated on the circumference of a disc 22, 24, 26, or 28, and each switch 60, 62, 64, and 66 is situated to contact the circumference of, respectively, the disc 22, 24, 26, or 28 as these discs rotate on the disc shaft 31, as shown in FIG. 3.

In operation, each switch 60, 62, 64, and 66 energizes an electronic actuation mechanism 10 when it makes contact with the conductive portion 37 of a disc 22, 24, 26, or 28, respectively. The contact between a switch and a conductive portion 37 is preferably a direct physical contact, but it can alternatively be a proximity contact, with a circuit being completed by means of an electrical arc across the conductive portion 37 and a switch. The source of electrical power is preferably a battery 38 whose positive terminal is connected to the timing wheel 34 and whose negative terminal is connected to the discs 22, 24, 26, and 28 as shown in FIG. 2. The battery 38 can be connected directly to the coordination assembly 4, as in FIG. 3, or indirectly via the distributor 50, as in FIG. 3.

In the preferred embodiment, one quarter of the surface of the inlet valve power disc 22 is composed of conductive material, as is one quarter of the exhaust valve power disc 24. That is, conductive material constitutes a ninety degree arc within the 360 degrees described by the power discs. The operation of the coordination assembly 4 is illustrated in an example of the operation of the inlet valve power disc 22 (FIG. 6A). As the inlet power disc 22 rotates, the inlet valve switch 60 comes into contact with the conductive portion 37 of the power disc 22 and energizes an electronic actuation mechanism 10 for a period corresponding to the passage of the arc of the conductive portion 37, in this case ninety degrees of the 360 degree rotation of the inlet power disc 22. The electronic actuation mechanism 10 opens the inlet valve 18 for the same period. After 90 degrees of rotation, the inlet valve switch 60 makes contact with the nonconducting portion 39 of the inlet valve power disc 22. As a result, electrical contact is broken, the electronic actuating mechanism 10 is de-energized, and the valve is closed, either by means of a valve spring (not shown) or by an active valve closure mechanism, to be described below. The electronic actuating mechanism 10 remains de-energized for the remainder of the 270 degree arc of the nonconducting portion 39 of the inlet valve power disc 22.

The proportion of conductive material in the discs 22, 24, 26, 28 can be other than one quarter of the contact surface, to provide periods of contact other than ninety degrees with switches 60, 62, 64, and 66. The conductive material can also be situated at positions other than upon the circumference of a disc as shown in FIG. 6. It can for example be situated as a strip of conductive material on one or both flat faces of a disc (not shown), with switches 60, 62, 64, and 66 situated so as to make contact with the conductive material during the rotation of the disc.

The conductive material can also occur at multiple positions on a single disc. For example, a disc can include a plurality of strips of conductive material situated as staggered parallel arcs on the circumference of a disc, with a matching plurality of switches situated to contact each arc during rotation of the disc. This configuration is especially advantageous in embodiments wherein multiple valves, spark plugs, fuel injectors or other engine components are coordinated by a single disc.

Preferably, the electronic actuating mechanisms 10 include an inlet solenoid 14 that actuates an inlet valve 18 and an exhaust solenoid 16 that actuates an exhaust valve 20. Preferably, there are two electronic actuating mechanisms 10 per piston 12 in the form of solenoids 14, 16. In multi-valve engines, multiple inlet solenoids 16 and exhaust valve solenoids 18 are included as required for each cylinder 8. Solenoids 14, 16 are electronic magnetic devices, and can be in the form of a piece of iron wound by a number of wires which can be electrified to create magnetic power. Any suitable type of solenoid can be used. Alternatively, the electronic actuating mechanism 10 can include motors, pneumatic technology, hydraulics, or any other suitable mechanism that can be used electronically to actuate valves. While solenoids are referred to as one example in the description below, it should be understood that other electronic actuating mechanisms 10 can be similarly used. One skilled in the art can determine the electrical power demands of each electronic actuating mechanism 10.

The all-time exhaust valve power disc 26 (FIG. 1C) partially energizes the exhaust solenoids 16 that actuate the exhaust valves 20 at all-times other than the point of ignition, when power to the exhaust valve power disc 24 is cut off. The effect of the all-time exhaust valve power disc 26 is to exert a positive pressure on the exhaust valves 20 to prevent pressure lock. Ignition and injection power disc 28 (FIG. 1D) powers spark plugs 30 and fuel injectors 32.

Figure 1D:
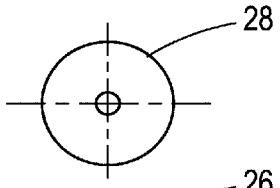
FIGS. 1A-1D are frontal views of power discs.
Figure 1C:
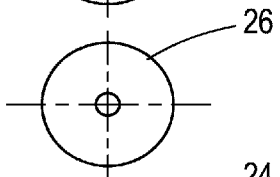
Figure 1B:
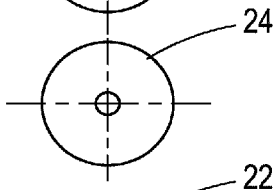
Figure 1A:
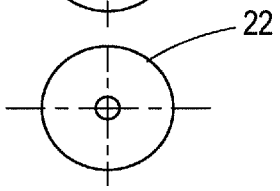
Figure 1E:
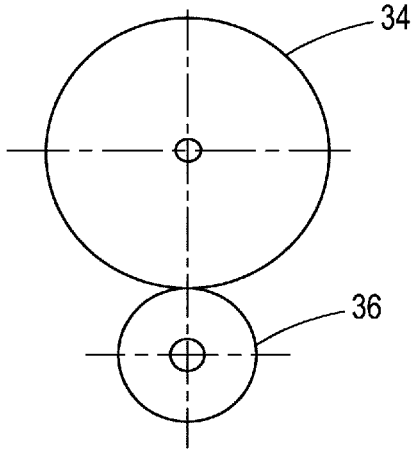
FIG. 1E is a frontal view of a timing wheel and crank shaft.
Figure 1F:
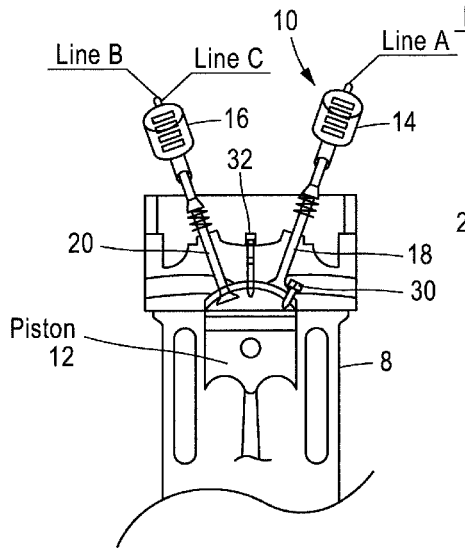
FIGS. 1F-1I are cross-sectional views of a piston in an engine with the electronic actuating mechanism.
Figure 1G:
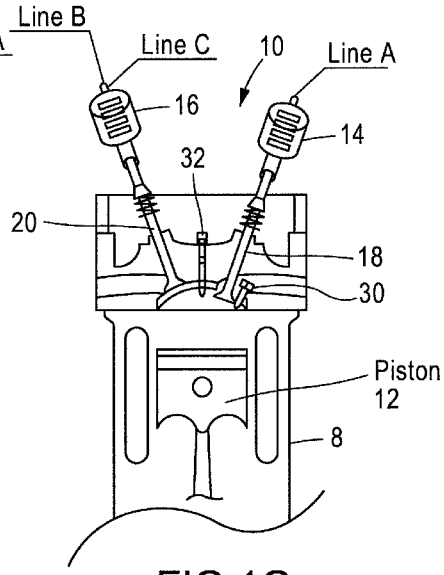
Figure 1H:
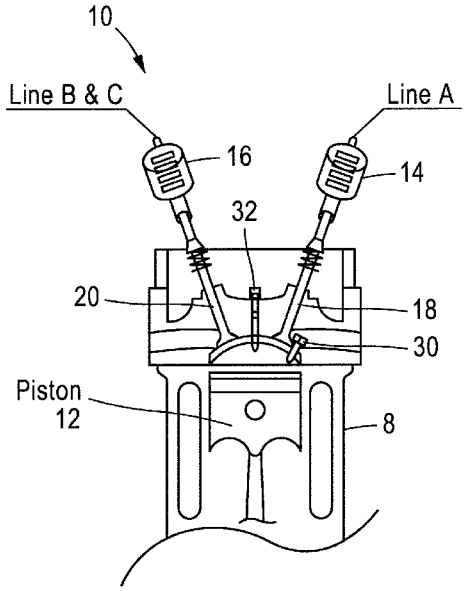
Figure 1I:
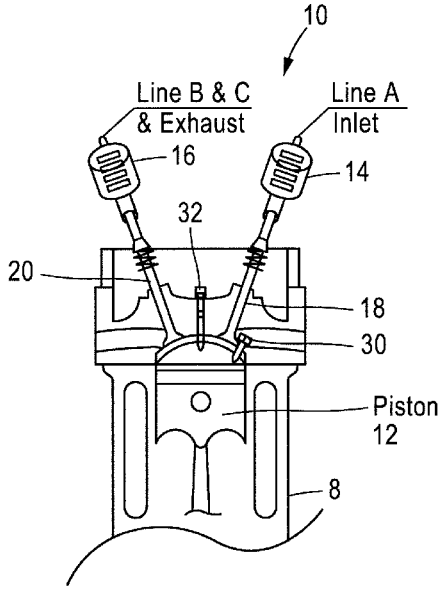

A distributor 50, shown in FIG. 1J, can have different terminals 52 for cylinder heads. The distributor 50 in FIG. 3 includes six terminals 52. Wires to the individual cylinder 8 from the distributor 50 are all connected to a positive terminal of the distributor 50. A rotor of the distributor 50 can be connected to the negative electrode, which also passes through discs 22, 24, 26, and 28.

Figure 3A:
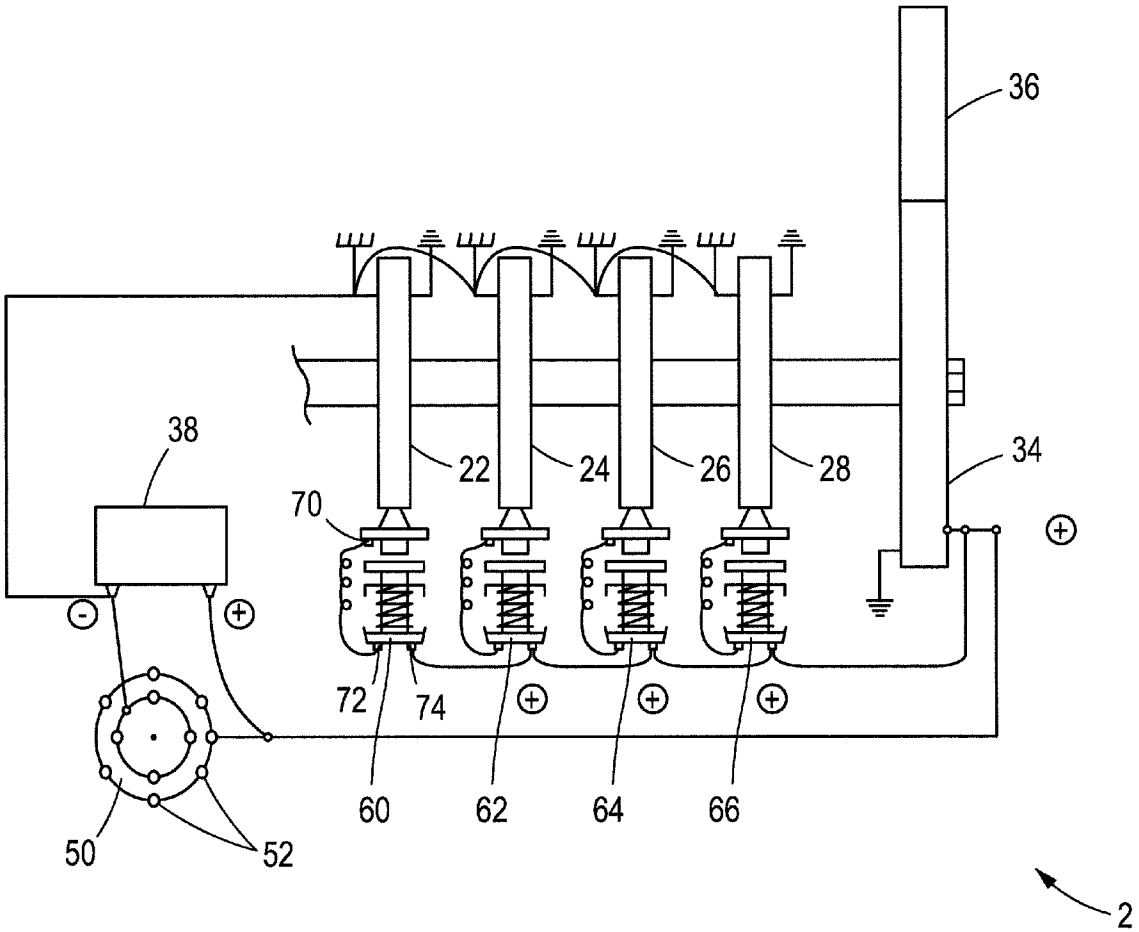
FIG. 3A is a side view of a coordination assembly and power source.
Figure 3B:
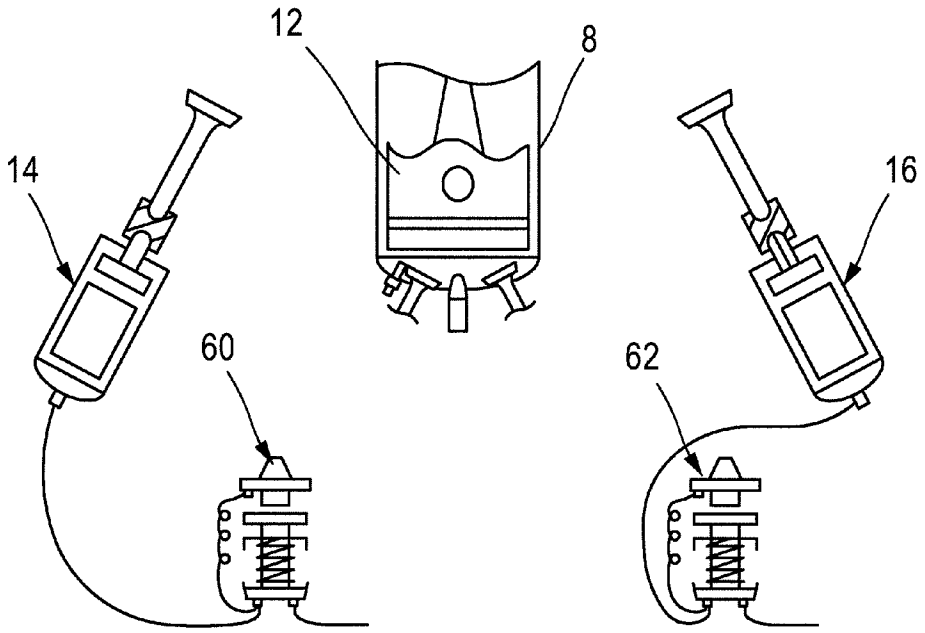
FIG. 3B is a side view of switches and electronic actuating mechanism.
Figure 4:
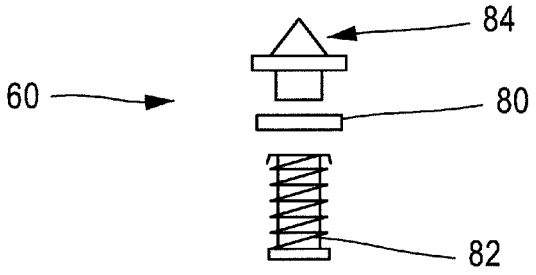
FIG. 4 is a break-away view of a switch.
Figure 5:
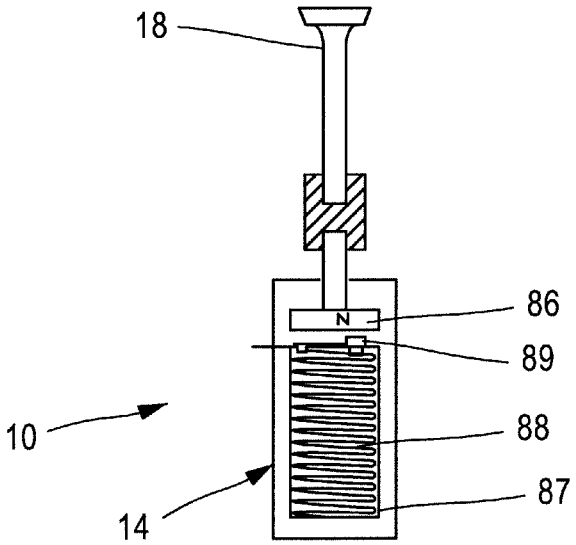
FIG. 5 is a cross-sectional view of a solenoid.

Each switch 60, 62, 64, and 66 includes a first terminal 70, a second terminal 72, and a third terminal 74, as shown in FIG. 3. Each switch 60, 62, 64, and 66 includes an upper portion 82 and a lower portion 84, the two portions being separated by a shim 80, as shown in FIG. 4. The upper portion 82 uppresses the lower portion 84 to make contact to one of the discs 22, 24, 26, 28. The shim 80 separates electric current when the upper portion 82 is energized. Each switch 60 and 62 is connected to solenoids 14 and 16, respectively, as shown in FIG. 3B. Each lower portion 84 transmits power to each solenoid 14 and 16. When each solenoid 14 and 16, is powered, it produces magnetic force within a magnetic portion 88. One end of each solenoid 14 and 16 includes a south pole 87 and the opposite end includes a north pole 89, as shown in FIG. 5. At the north pole 89, there is a magnetic plunger 86 that is also magnetized with the north pole 89 and is a moving part.

The coordination assembly 4 times the inlet solenoid 16 to be energized to open the inlet valve when the piston 12 is moving down from top dead center to bottom dead center during the introduction of air/fuel in the cylinder 8. When the piston 12 reaches the bottom dead center, which is the end of the inlet cycle and the beginning of compression stroke. The coordination assembly 4 times the exhaust solenoid 18 to be energized to open the exhaust valve when the piston 12 is moving upward from bottom dead center to top dead center after the end of the power stroke.

As solenoids can produce heat during operation, the area of the cylinder head surrounding the solenoids is preferably composed of a material of high heat conductance and high heat resistance (not shown). Alternatively, a water jacket can be situated about the cylinder head (not shown).

The camless engine operating system 2 can be automatically adjustable or manually adjustable to optimize power, fuel efficiency, and emissions according to various driving conditions. For example, actuation of valves and other engine components can be accelerated or decelerated to adjust for engine speed, and to harmonize with such features as variable dwell ignition and ram induction airflow. Although the basic patterns of the action of the solenoids or other electronic actuating systems 10 are determined by patterns of power delivery from the discs 22, 24, 26, and 28, these patterns can be modified by commands from the electronic engine control unit (ECU) 40, the engine computer that is found in most engines.

Figure 7:
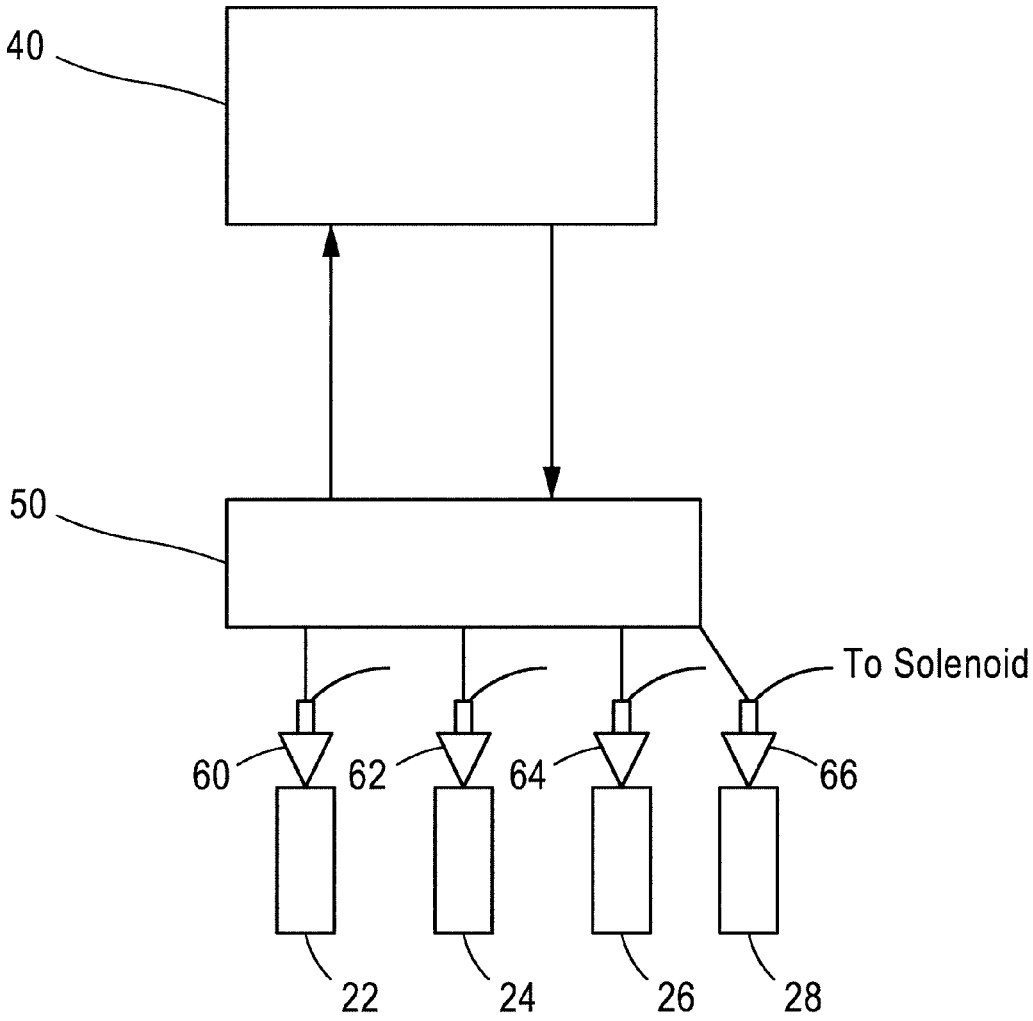
FIG. 7 is a flowchart of flow of information from a computer to and from the engine.
Figure 8A:
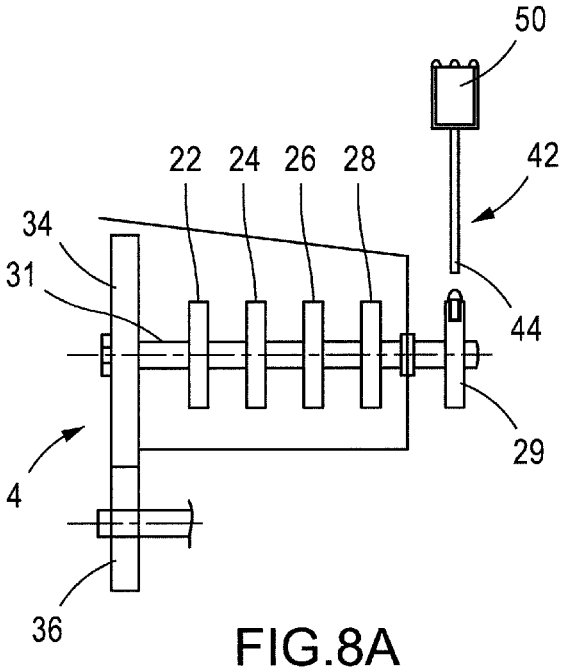
FIG. 8A is a schematic view of an optical signaling disc in relation to a distributor.
Figure 8B:
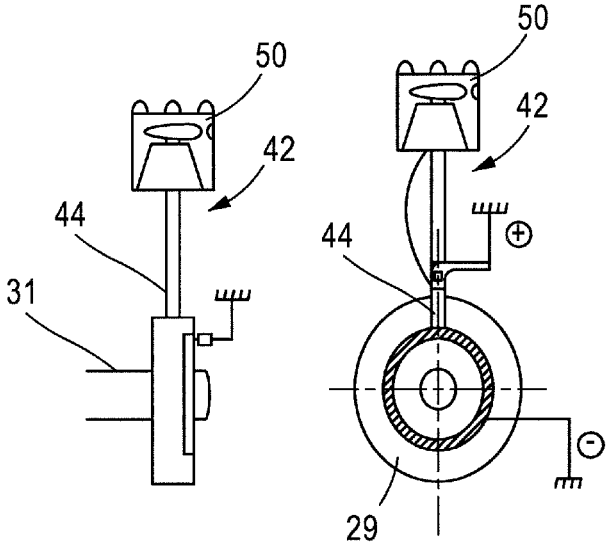
FIG. 8B is a side view (left panel) and a frontal view (right panel) of an electronic signaling disc.

In the preferred embodiment, the electronic actuating system 10 is in communication with the ECU 40 either directly, or indirectly via the distributor 50, as shown in FIG. 7. Signals from the ECU 40 flow to the electronic actuating mechanism 10 via switches 60, 62, 64, 66, and discs 22, 24, 26, 28. Feedback from the electronic actuating mechanism 10 flows back to the ECU 40 to be integrated with signals from the distributor 50 and from other engine operating systems. In one embodiment of the electronic actuating mechanism 10, the ECU 40 monitors the speed of the disc shaft 31 by means of a sensing mechanism 42 that includes a signaling disc 29 attached to the disc shaft 31, and a sensor 44 to detect the rotation of the signaling disc 29, as shown in FIG. 8. The sensor 44 is communicatively connected to a processor (not shown) that converts rotation of the signaling disc 29 into a rate of rotation and conveys this rate of rotation to the distributor 50 and/or ECU 40. The sensor 44 can detect the rotation of the signaling disc 29 optically, by reading the reflection or transmission of light by a visual pattern included on the surface of the signaling disc 29 (FIG. 8A), or electronically, for example by measuring current induced in a coil by a magnet rotated by the signaling disc 29 (FIG. 8B). The ECU 40 can also do multi-task commands simultaneously, opening the valves 18, 20 and closing them on the same cycle. Users can manually adjust the ECU 40 by means of a touch screen display (not shown).

The camless engine operating system 2 of the present invention is especially useful in conjunction with a variable dwell ignition system. In a variable dwell ignition system, dwell is increased as engine RPM increases, to achieve peak power at all engine speeds. Variable dwell can also allow an engine to run on alternative fuels that are incompatible with a constant dwell system, such as fuel mixtures containing greater than 10% ethanol. To maintain maximum combustion efficiency in a variable dwell system, valves must be kept open longer as dwell increases. The camless engine operating system 2 of the present invention integrates well with a variable dwell ignition system, as the pattern of power delivery from the inlet valve power disc 22, exhaust valve power disc 24, and all-time exhaust valve power disc 26, can be modified by dwell-time indicating signals emanating from the ECU 40 and/or distributor 50.

The camless engine operating system of the present invention is also useful in engines employing a ram induction system. In a ram induction system, a supercharger-like effect is achieved by producing resonance in the air column in an intake runner leading to a cylinder 8. With the proper timing of opening and closing of the intake valve, a positive pressure wave in the air column is generated, with the wave passing into the cylinder 8 at the instant that the intake valve opens. The ram induction effect produces higher power and cleaner, more efficient fuel combustion. The camless engine operating system 2 of the present invention is compatible with a ram induction system because the timing of valve opening can be adjusted by the ECU 40 to take advantage of the differently timed pressure waves produced under diverse operating conditions.

The camless engine operating system 2 of the present invention can be manufactured as part of the engine or as an after market add-on. Therefore, any conventional engine can be fitted with a camless engine operating system 2 to improve its efficiency and fuel economy. The camless engine operating system 2 is a "green" engine with has many intrinsic environmental benefits. It conserves energy use because it is much lighter in weight than a comparable conventional engine, lacking a camshaft, a timing chain, a timing gear, pushrods, or rocker arms. The energy drain on the crankshaft is reduced, because the crankshaft only powers the rotation of discs 22-29 past switches or sensors, rather than powering a massive camshaft and rocker arms. The compatibility of the present invention with variable dwell ignition enables the use of alternative fuels such as biofuels.

The present invention is also readily adapted for operation in a diesel engine. The structure and function of a diesel embodiment of the electronic actuating mechanism 10 is essentially as described previously for a gasoline engine, except that the distributor 50 is omitted and disc 28 is a power disc for injection only, and does not control ignition. Furthermore, the present invention is readily adapted for use in non-combustion engines, and in any device requiring the timed operation of valves. For example, the camless engine operating system 2 of the present invention is compatible with steam engines, dispensers of solids, liquids, and vapors, and hydraulic systems of any type.

The present invention also provides for a method of electronically operating an engine, by supplying power to a coordination assembly 4, energizing an electronic actuating mechanism 10, and actuating at least one piston 12 in the engine. By performing this method, efficiency of the engine is improved. The camless engine operating system is essentially a set of on-off switches that actuate valves and is easily adapted to also actuate any other device in the engine, as needed. This method can include adjusting the performance of the electronic actuating mechanism 10 either automatically or manually based on any number of conditions as described above.

In one example of operation, the combustion cycle of a camless engine includes four strokes as in a traditional engine, including an inlet stroke, compression stroke, power stroke, and exhaust stroke, shown in FIGS. 6A and 6B. The camless engine starts its inlet stroke by supplying power to the inlet solenoid 14 as the conductive portion 37 of the inlet valve power disc 22 contacts the inlet valve switch 60, during the first 90 degrees of its rotation. During this interval, the piston 12 moves from Top Dead Center (TDC) to Bottom Dead Center (BDC), and the inlet valve 18 is fully open from the beginning of the air/fuel suction to the end of the inlet stroke. At the end of the inlet stroke, the inlet valve switch 60 contacts the start of the 270 degree arc that represents the nonconductive portion of the inlet valve power disc 22. The valve spring (not shown) automatically forces the inlet valve 18 to close, because the inlet solenoid 14 is depowered for the rest of the 270 degrees of the rotation of the inlet valve power disc 22.

During the compression stroke, both the inlet valve 18 and the exhaust valve 20 are closed, as the nonconducting portions 39 of the inlet valve power disc 22 and exhaust valve power disc 24 contact the inlet valve switch 60 and the exhaust valve switch 62. Once the compression stroke is over, the power stroke starts. By this time, the piston 12 is moving from the TDC to the BDC. Just before the bottom BDC, the conductive portion of the exhaust power disc 24 contacts the exhaust valve switch 62 to provide power to energize the exhaust solenoid 16 thereby opening the exhaust valve 20. The conductive portion of the exhaust power disc 24 contacts the exhaust valve switch 62 for the entire ensuing ninety degrees of rotation of the exhaust power disc 24. As a result, the exhaust valve is fully open from the beginning of the exhaust stroke to the end. The same order of operation is carried out for each additional cylinder 8 in the firing order.

Figure 9:
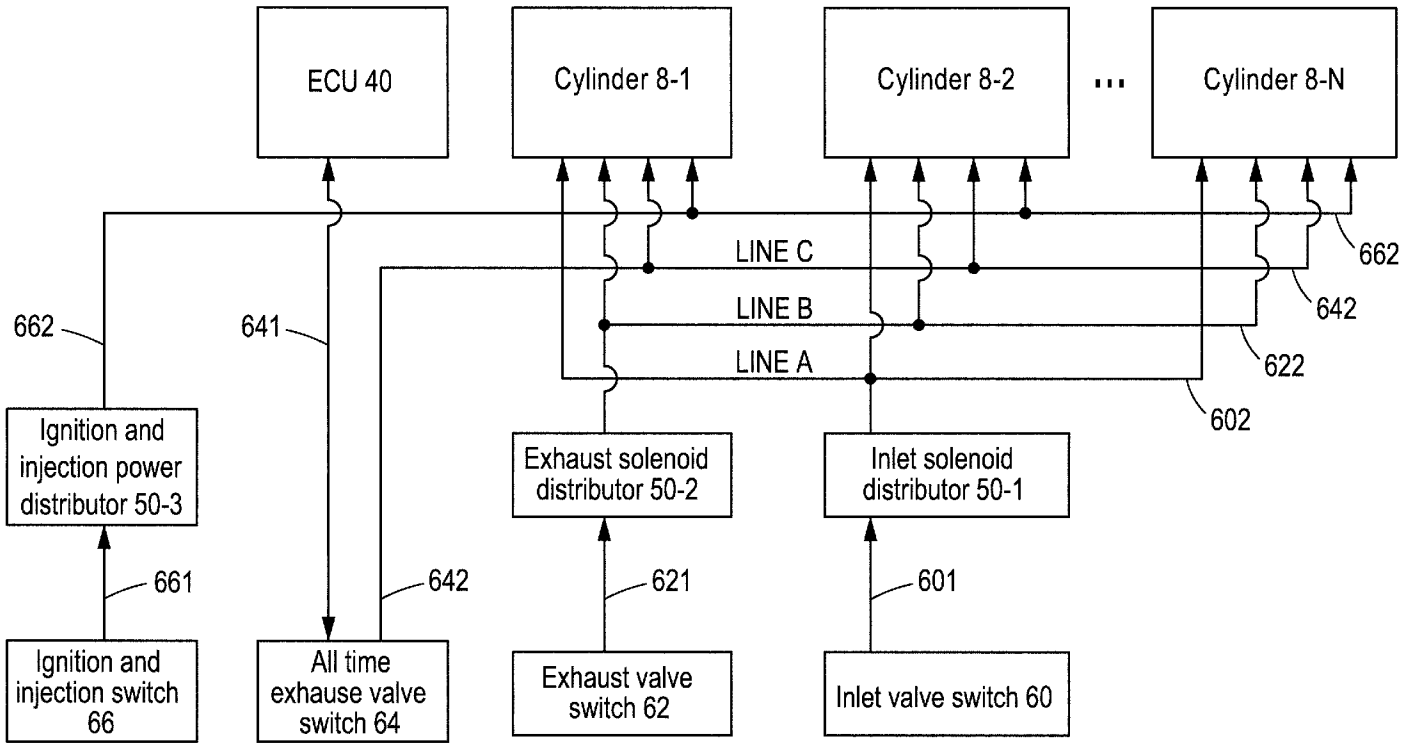
FIG. 9 is a block diagram of the camless engine operating system.
Figure 10A:
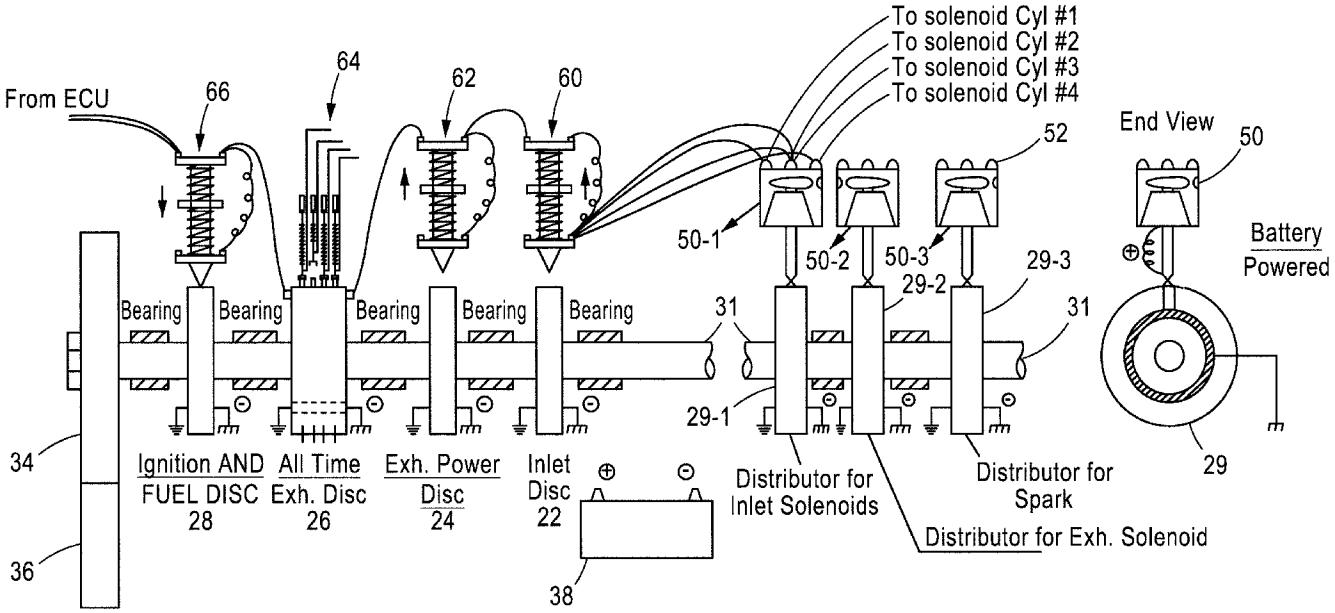
FIG. 10A is a view of the camless engine operating system.

FIG. 9 is a block diagram of the camless engine operating system. In addition, FIG. 10A is an overall view of the camless engine operating system 2. Shown within FIGS. 9 and 10A are an inlet actuator distributor 50-1, an exhaust actuator distributor 50-2, and an ignition and injection power distributor 50-3. Each of the distributors 50-1, 50-2, and 50-3 in FIG. 10A are examples of the previously-described distributor 50, which can have different terminals 52 for the cylinders.

Also shown within FIG. 10A are a signaling disc 29-1, a signaling disc 29-2, and a signaling disc 29-3. Each of the signaling discs 29-1, 29-2, and 29-3 in FIG. 10A are examples of the previously-described signaling disc 29. In this regard, each of the signaling discs 29-1, 29-2, and 29-3 in FIG. 10A are fixedly mounted coaxially upon a common disc shaft 31 along with the discs 22, 24, 26, and 28. Similar to the signaling disc in FIGS. 8A and 8B, a sensor 44 is associated with each of the signaling discs 29-1, 29-2, and 29-3 in FIG. 10A to detect the rotation of the signaling discs 29-1, 29-2, and 29-3, as shown in FIG. 8.

In particular, an inlet actuator sensor 44 associated with the inlet actuator signaling disc 29-1 of FIG. 10A can detect the rotation of the inlet actuator signaling disc 29-1. The inlet actuator sensor 44 is communicatively connected to the ECU 40 or another processor to convert rotation of the inlet actuator signaling disc 29-1 into a rate of rotation and conveys this rate of rotation to the inlet actuator distributor 50-1 and/or ECU 40.

An exhaust actuator sensor 44 associated with the exhaust actuator signaling disc 29-2 of FIG. 10A can detect the rotation of the exhaust actuator signaling disc 29-2. The exhaust actuator sensor 44 is communicatively connected to the ECU 40 or another processor to convert rotation of the exhaust actuator signaling disc 29-2 into a rate of rotation and conveys this rate of rotation to the exhaust actuator distributor 50-2 and/or ECU 40.

In particular, an ignition and injection power sensor 44 associated with the ignition and injection power signaling disc 29-3 of FIG. 10A can detect the rotation of the ignition and injection power signaling disc 29-3. The ignition and injection power sensor 44 is communicatively connected to the ECU 40 or another processor to convert rotation of the ignition and injection power signaling disc 29-3 into a rate of rotation and conveys this rate of rotation to the ignition and injection power distributor 50-3 and/or ECU 40.

Shown within FIGS. 9 and 10A, the inlet valve switch 60 is configured to detect rotational movement of an inlet valve power disc 22 and to output an inlet actuator voltage. The distributor 50 in FIG. 3A includes six terminals 52. The inlet valve switch 60 in FIG. 3A includes a terminal 70. Referring to FIGS. 9 and 10A, the inlet valve switch signal lines 601 provide a direct electrical connection between each of the terminals 52 for the inlet actuator distributor 50-1 and the terminal 70 of the inlet valve switch 60. Specifically, the inlet valve switch 60 provides inlet switch voltages to an inlet actuator distributor 50-1 over the inlet valve switch signal lines 601. The inlet actuator distributor 50-1 sequentially reroutes the inlet switch voltages onto the inlet actuator voltage signal lines 602 to provide inlet actuator voltages to the cylinders 8-1 through 8-N over the inlet actuator voltage signal lines 602, the inlet switch voltages after being rerouted becomes the inlet actuator voltages. A voltage level of an inlet actuator voltage is synchronous with the rotational movement of the inlet valve power disc 22. The number "N" in FIG. 9 is the number of cylinders 8 in an engine.

As shown in FIGS. 1F, 1G, 1H, and 1I, each of the cylinders 8 has an inlet valve 18 that is movable to open and close an intake port of a combustion chamber. An inlet actuator 14 within the cylinders 8 is configured to exert the inlet valve mechanical force onto the inlet valve 18. An inlet valve mechanical force exerted by the inlet actuator 14 moves the inlet valve 18 to open the intake port. The inlet actuator voltage received by the inlet actuator 18 controls the inlet actuator 14 to exert the inlet valve mechanical force onto the inlet valve 18. The amount of the inlet valve mechanical force exerted onto the inlet valve 18 is synchronous with the rotational movement of the inlet valve power disc 22. The inlet valve 18 is closed either by means of a valve spring or by an active valve closure mechanism.

Figure 10C:
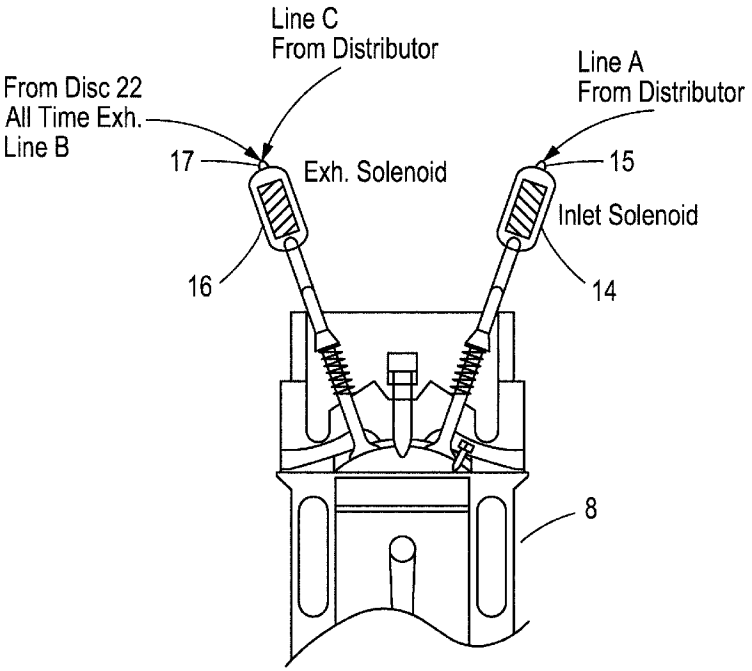
FIG. 10C is a configuration for a cylinder.

An inlet actuator terminal 15 is shown in FIG. 10C. LINE A in FIGS. 1F, 1G, 1H, and 1I is directly electrically connected to the inlet actuator terminal 15. LINE A in FIGS. 1F, 1G, 1H, and 1I being shown in FIG. 9 as the inlet actuator voltage signal lines 602 is within the scope of the invention. Likewise, LINE A in FIGS. 1F, 1G, 1H, and 1I being shown in FIG. 9 as a combination of the inlet valve switch signal lines 601 and the inlet actuator voltage signal lines 602 is also within the scope of the invention. In this regard, direct electrical connections exist between the terminals 52 for the inlet actuator distributor 50-1 and the inlet actuator terminal 15 of the inlet actuator 14.

In a four-cylinder engine, for example, during a first fuel intake time period, the first one of the inlet valve switch signal lines 601 provides an inlet switch voltage appearing at the terminal 70 of the inlet valve switch 60 to the first one of the terminals 52 for the inlet actuator distributor 50-1. The inlet actuator distributor 50-1 during the first fuel intake time period reroutes the inlet switch voltage appearing at the first one of the terminals 52 for the inlet actuator distributor 50-1 onto a first one of the inlet actuator voltage signal lines 602, whereby the inlet switch voltage becomes an inlet actuator voltage on the first one of the inlet actuator voltage signal lines 602. The first one of the inlet actuator voltage signal lines 602 provides a direct electrical connection between the first one of the terminals 52 for the inlet actuator distributor 50-1 and the inlet actuator terminal 15 of the first inlet actuator 14.

During a second fuel intake time period, the second one of the inlet valve switch signal lines 601 provides an inlet switch voltage appearing at the terminal 70 of the inlet valve switch 60 to the second one of the terminals 52 for the inlet actuator distributor 50-1. The inlet actuator distributor 50-1 during the second fuel intake time period reroutes the inlet switch voltage appearing at the second one of the terminals 52 for the inlet actuator distributor 50-1 onto a second one of the inlet actuator voltage signal lines 602, whereby the inlet switch voltage becomes an inlet actuator voltage on the second one of the inlet actuator voltage signal lines 602. The second one of the inlet actuator voltage signal lines 602 provides a direct electrical connection between the second one of the terminals 52 for the inlet actuator distributor 50-1 and the inlet actuator terminal 15 of the second inlet actuator 14. The second fuel intake time period occurring during a time period other than the first fuel intake time period is within the scope of the invention. Alternatively, the second fuel intake time period occurring simultaneously with the first fuel intake time period is also within the scope of the invention.

During a third fuel intake time period, the third one of the inlet valve switch signal lines 601 provides an inlet switch voltage appearing at the terminal 70 of the inlet valve switch 60 to the third one of the terminals 52 for the inlet actuator distributor 50-1. The inlet actuator distributor 50-1 during the third fuel intake time period reroutes the inlet switch voltage appearing at the third one of the terminals 52 for the inlet actuator distributor 50-1 onto a third one of the inlet actuator voltage signal lines 602, whereby the inlet switch voltage becomes an inlet actuator voltage on the third one of the inlet actuator voltage signal lines 602. The third one of the inlet actuator voltage signal lines 602 provides a direct electrical connection between the third one of the terminals 52 for the inlet actuator distributor 50-1 and the inlet actuator terminal 15 of the third inlet actuator 14. The third fuel intake time period occurring during a time period other than either the first fuel intake time period or the second fuel intake time period is within the scope of the invention. Alternatively, third fuel intake time period occurring simultaneously with either the first fuel intake time period or the second fuel intake time period is also within the scope of the invention.

During a fourth fuel intake time period, the fourth one of the inlet valve switch signal lines 601 provides an inlet switch voltage appearing at the terminal 70 of the inlet valve switch 60 to the fourth one of the terminals 52 for the inlet actuator distributor 50-1. The inlet actuator distributor 50-1 during the fourth fuel intake time period reroutes the inlet switch voltage appearing at the fourth one of the terminals 52 for the inlet actuator distributor 50-1 onto a fourth one of the inlet actuator voltage signal lines 602, whereby the inlet switch voltage becomes an inlet actuator voltage on the fourth one of the inlet actuator voltage signal lines 602. The fourth one of the inlet actuator voltage signal lines 602 provides a direct electrical connection between the fourth one of the terminals 52 for the inlet actuator distributor 50-1 and the inlet actuator terminal 15 of the fourth inlet actuator 14. The fourth fuel intake time period occurring during a time period other than either the first fuel intake time period, the second fuel intake time period, or the third fuel intake time period is within the scope of the invention. Alternatively, the fourth fuel intake time period occurring simultaneously with either the first fuel intake time period, the second fuel intake time period, or the third fuel intake time period is also within the scope of the invention.

It should be appreciated that this configuration is not limited to a four-cylinder engine. Instead, this configuration could also be applied to engines having a number of cylinders other than four cylinders.

An exhaust valve switch 62 is configured to detect rotational movement of an exhaust valve power disc 24 and to output an exhaust actuator voltage. Specifically, the exhaust valve switch 62 provides exhaust switch voltages to an exhaust actuator distributor 50-2 over the exhaust valve switch signal lines 621. The exhaust actuator distributor 50-2 sequentially reroutes the exhaust switch voltages onto the exhaust actuator voltage signal lines 622 to provide exhaust actuator voltages to the cylinders 8-1 through 8-N over the exhaust actuator voltage signal lines 622, the exhaust switch voltages after being rerouted becomes the exhaust actuator voltages. A voltage level of an exhaust actuator voltage is synchronous with the rotational movement of the exhaust valve power disc 24. In addition, the inlet valve power disc 22 and the exhaust valve power disc 24 are fixedly mounted coaxially upon a common disc shaft 31, as shown in FIG. 2. Accordingly, the rotational movement of the inlet valve power disc 22 is synchronous with the rotational movement of the exhaust valve power disc 24.

As shown in FIGS. 1F, 1G, 1H, and 1I, each of the cylinders 8 has an exhaust valve 20 that is movable to open and close an exhaust port of a combustion chamber. An exhaust actuator 16 within the cylinders 8 is configured to exert the exhaust valve mechanical force onto the exhaust valve 20. An exhaust valve mechanical force exerted by the exhaust actuator 16 moves the exhaust valve 20 to open the exhaust port. The inlet actuator voltage received by the inlet actuator 18 controls the exhaust actuator 16 to exert the exhaust valve mechanical force onto the exhaust valve 20. The amount of the exhaust valve mechanical force exerted onto the exhaust valve 20 is synchronous with the rotational movement of the exhaust valve power disc 24. The exhaust valve 20 is closed either by means of a valve spring or by an active valve closure mechanism.

A similar configuration exists regarding the electronic connections between the exhaust valve switch 62 and the exhaust actuator distributor 50-2. In particular, the exhaust valve switch 62 in FIG. 3A includes a terminal 70. Exhaust valve switch signal lines 621 provide a direct electrical connection between each of the terminals 52 for the exhaust actuator distributor 50-2 and the terminal 70 of the exhaust valve switch 62.

An exhaust actuator terminal 17 is shown in in FIG. 10C. LINE B in FIGS. 1F, 1G, 1H, and 1I is directly electrically connected to the exhaust actuator terminal 17. LINE B in FIGS. 1F, 1G, 1H, and 1I being shown in FIG. 9 as the exhaust actuator voltage signal lines 622 is within the scope of the invention. Likewise, LINE B in FIGS. 1F, 1G, 1H, and 1I being shown in FIG. 9 as a combination of the exhaust valve switch signal lines 621 and the exhaust actuator voltage signal lines 622 is also within the scope of the invention. In this regard, direct electrical connections exist between the terminals 52 for the exhaust actuator distributor 50-2 and the exhaust actuator terminal 17 of the exhaust solenoid 16.

In the four-cylinder engine example, during a first fuel exhaust time period, the first one of the exhaust valve switch signal lines 621 provides an exhaust switch voltage appearing at the terminal 70 of the exhaust valve switch 62 to the first one of the terminals 52 for the exhaust actuator distributor 50-2. The exhaust actuator distributor 50-2 during the first fuel exhaust time period reroutes the exhaust switch voltage appearing at the first one of the terminals 52 for the exhaust actuator distributor 50-2 onto a first one of the exhaust actuator voltage signal lines 622, whereby the exhaust switch voltage becomes an exhaust actuator voltage on the first one of the exhaust actuator voltage signal lines 622. The first one of the exhaust actuator voltage signal lines 622 provides a direct electrical connection between the first one of the terminals 52 for the exhaust actuator distributor 50-2 and the exhaust actuator terminal 15 of the first exhaust actuator 16.

During the second fuel exhaust time period, the second one of the exhaust valve switch signal lines 621 provides an exhaust switch voltage appearing at the terminal 70 of the exhaust valve switch 62 to the second one of the terminals 52 for the exhaust actuator distributor 50-2. The exhaust actuator distributor 50-2 during the second fuel exhaust time period reroutes the exhaust switch voltage appearing at the second one of the terminals 52 for the exhaust actuator distributor 50-2 onto a second one of the exhaust actuator voltage signal lines 622, whereby the exhaust switch voltage becomes an exhaust actuator voltage on the second one of the exhaust actuator voltage signal lines 622. The second one of the exhaust actuator voltage signal lines 622 provides a direct electrical connection between the second one of the terminals 52 for the exhaust actuator distributor 50-2 and the exhaust actuator terminal 15 of the second exhaust actuator 16. The second fuel exhaust time period occurring during a time period other than the first fuel exhaust time period is within the scope of the invention. Alternatively, the second fuel exhaust time period occurring simultaneously with the first fuel exhaust time period is also within the scope of the invention.

During the third fuel exhaust time period, the third one of the exhaust valve switch signal lines 621 provides an exhaust switch voltage appearing at the terminal 70 of the exhaust valve switch 62 to the third one of the terminals 52 for the exhaust actuator distributor 50-2. The exhaust actuator distributor 50-2 during the third fuel exhaust time period reroutes the exhaust switch voltage appearing at the third one of the terminals 52 for the exhaust actuator distributor 50-2 onto a third one of the exhaust actuator voltage signal lines 622, whereby the exhaust switch voltage becomes an exhaust actuator voltage on the third one of the exhaust actuator voltage signal lines 622. The third one of the exhaust actuator voltage signal lines 622 provides a direct electrical connection between the third one of the terminals 52 for the exhaust actuator distributor 50-2 and the exhaust actuator terminal 15 of the third exhaust actuator 16. The third fuel exhaust time period occurring during a time period other than either the first fuel exhaust time period or the second fuel exhaust time period is within the scope of the invention. Alternatively, third fuel exhaust time period occurring simultaneously with either the first fuel exhaust time period or the second fuel exhaust time period is also within the scope of the invention.

During the fourth fuel exhaust time period, the fourth one of the exhaust valve switch signal lines 621 provides an exhaust switch voltage appearing at the terminal 70 of the exhaust valve switch 62 to the fourth one of the terminals 52 for the exhaust actuator distributor 50-2. The exhaust actuator distributor 50-2 during the fourth fuel exhaust time period reroutes the exhaust switch voltage appearing at the fourth one of the terminals 52 for the exhaust actuator distributor 50-2 onto a fourth one of the exhaust actuator voltage signal lines 622, whereby the exhaust switch voltage becomes an exhaust actuator voltage on the fourth one of the exhaust actuator voltage signal lines 622. The fourth one of the exhaust actuator voltage signal lines 622 provides a direct electrical connection between the fourth one of the terminals 52 for the exhaust actuator distributor 50-2 and the exhaust actuator terminal 15 of the fourth exhaust actuator 16. The fourth fuel exhaust time period occurring during a time period other than either the first fuel exhaust time period, the second fuel exhaust time period, or the third fuel exhaust time period is within the scope of the invention. Alternatively, the fourth fuel exhaust time period occurring simultaneously with either the first fuel exhaust time period, the second fuel exhaust time period, or the third fuel exhaust time period is also within the scope of the invention. It should be appreciated that this configuration is not limited to a four-cylinder engine. Instead, this configuration could also be applied to engines having a number of cylinders other than four cylinders.

Figure 10B:
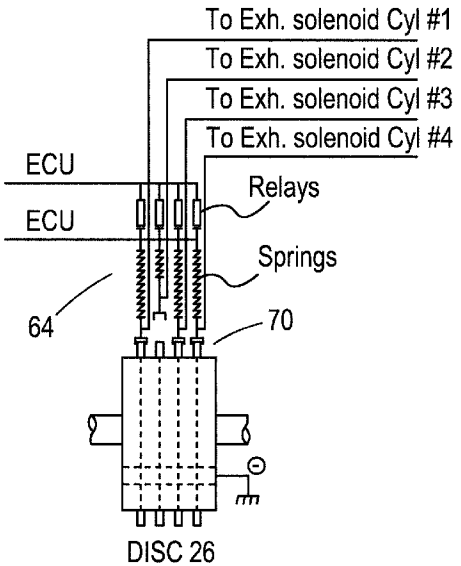
FIG. 10B is a configuration for an all-time exhaust power disc.

Shown in FIGS. 3A and 10B is an all-time exhaust power disc 26 that energizes the exhaust solenoid 16 when the cylinder 8 is not in firing order. The all-time exhaust valve switch 64 is in contact with the all-time exhaust valve power disc 26. LINE C in FIGS. 1F, 1G, 1H, and 1I is directly electrically connected to the all-time exhaust valve switch 64. LINE C in FIGS. 1F, 1G, 1H, and 1I being shown in FIG. 9 as the all-time exhaust valve switch voltage signal lines 642 is within the scope of the invention.

Additionally shown in FIG. 10B, the all-time exhaust valve switch 64 receives voltage signals from the ECU 40 and provides voltage signals to the ECU 40. Over the ECU voltage signal lines 641 in FIG. 9, the all-time exhaust valve switch 64 provides ECU signals to the ECU 40 and receives ECU signals from the ECU 40. In particular, FIG. 10B depicts the presence of the relays in the all-time exhaust valve switch 64. ECU signals from the ECU 40 to the all-time exhaust valve switch 64 control the opening and closure of the relays in the all-time exhaust valve switch 64. As shown in FIG. 10B, the opening of a relay in the all-time exhaust valve switch 64 produces an open circuit to inhibit generation of a corresponding all-time exhaust valve switch voltage. Closure of the relay the all-time exhaust valve switch 64 permits generation of the corresponding all-time exhaust valve switch voltage. The all-time exhaust valve switch 64 provides all-time exhaust valve switch voltages to the cylinders 8-1 through 8-N over the all-time exhaust valve switch voltage signal lines 642. ECU signals to the ECU 40 from the all-time exhaust valve switch 64 indicate the presence or absence of an all-time exhaust valve switch voltage on a corresponding all-time exhaust valve switch voltage signal line 642. It should be appreciated that this configuration is not limited to a four-cylinder engine. Instead, this configuration could also be applied to engines having a number of cylinders other than four cylinders.

In addition, in the four-cylinder engine example, a first one of the all-time exhaust valve switch voltage signal lines 642 provides a direct electrical connection between a first one of the terminals 70 in FIG. 10B and the exhaust actuator terminal 17 of the first exhaust actuator 16. A second one of the all-time exhaust valve switch voltage signal lines 642 provides a direct electrical connection between a second one of the terminals 70 in FIG. 10B and the exhaust actuator terminal 17 of the second exhaust actuator 16. A third one of the all-time exhaust valve switch voltage signal lines 642 provides a direct electrical connection between a third one of the terminals 70 in FIG. 10B and the exhaust actuator terminal 17 of the third exhaust actuator 16. A fourth one of the all-time exhaust valve switch voltage signal lines 642 provides a direct electrical connection between a fourth one of the terminals 70 in FIG. 10B and the exhaust actuator terminal 17 of the fourth exhaust actuator 16. It should be appreciated that this configuration is not limited to a four-cylinder engine. Instead, this configuration could also be applied to engines having a number of cylinders other than four cylinders.

A similar configuration exists regarding the electronic connections between the ignition and injection switch 66 and the cylinders 8-1 through 8-N. Here, the ignition and injection power distributor 50-3 provides ignition and injection distributor voltages to the cylinders 8-1 through 8-N over the ignition and injection switch signal lines 661. In particular, the ignition and injection switch 66 in FIG. 3A includes a terminal 70. The ignition and injection switch 66 provides ignition and injection switch voltages to the ignition and injection power distributor 50-3 over the ignition and injection switch signal lines 661. The ignition and injection switch signal lines 661 provide a direct electrical connection between each of the terminals 52 for the ignition and injection power distributor 50-3 and the first terminal 70 of the ignition and injection switch 66.

Spark plugs 30 and fuel injectors 32 are shown in FIGS. 1F, 1G, 1H, and 1I. Each of the cylinders 8 has spark plugs 30 and fuel injectors 32. Ignition and fuel voltage signal lines 662 provide a direct electrical connection between the terminals 52 for the ignition and injection power distributor 50-3 and the spark plugs 30. Likewise, the ignition and fuel voltage signal lines 662 provide a direct electrical connection between the terminals 52 for the ignition and injection power distributor 50-3 and the fuel injectors 32.

In the four-cylinder engine example, during a first ignition and injection time period, the first one of the ignition and injection switch signal lines 661 provides an ignition and injection switch voltage appearing at the terminal 70 of the ignition and injection switch 66 to the first one of the terminals 52 for the ignition and injection power distributor 50-3. The ignition and injection power distributor 50-3 during the first ignition and injection time period reroutes the ignition and injection switch voltage appearing at the first one of the terminals 52 for the ignition and injection power distributor 50-3 onto a first one of the ignition and fuel voltage signal lines 662, whereby the first one of the ignition and fuel voltage signal lines 662 supplies the ignition and injection switch voltage to either a spark plug 30 in the first one of the cylinders 8 or a fuel injector 32 in the first one of the cylinders 8, or both.

During the second ignition and injection time period, the second one of the ignition and injection switch signal lines 661 provides an ignition and injection switch voltage appearing at the terminal 70 of the ignition and injection switch 66 to the second one of the terminals 52 for the ignition and injection power distributor 50-3. The ignition and injection power distributor 50-3 during the second ignition and injection time period reroutes the ignition and injection switch voltage appearing at the second one of the terminals 52 for the ignition and injection power distributor 50-3 onto a second one of the ignition and fuel voltage signal lines 662, whereby the second one of the ignition and fuel voltage signal lines 662 supplies the ignition and injection switch voltage to either a spark plug 30 in the second one of the cylinders 8 or a fuel injector 32 in the second one of the cylinders 8, or both. The second ignition and injection time period occurring during a time period other than the first ignition and injection time period is within the scope of the invention. Alternatively, the second ignition and injection time period occurring simultaneously with the first ignition and injection time period is also within the scope of the invention.

During the third ignition and injection time period, the third one of the ignition and injection switch signal lines 661 provides an ignition and injection switch voltage appearing at the terminal 70 of the ignition and injection switch 66 to the third one of the terminals 52 for the ignition and injection power distributor 50-3. The ignition and injection power distributor 50-3 during the third ignition and injection time period reroutes the ignition and injection switch voltage appearing at the third one of the terminals 52 for the ignition and injection power distributor 50-3 onto a third one of the ignition and fuel voltage signal lines 662, whereby the third one of the ignition and fuel voltage signal lines 662 supplies the ignition and injection switch voltage to either a spark plug 30 in the third one of the cylinders 8 or a fuel injector 32 in the third one of the cylinders 8, or both. The third ignition and injection time period occurring during a time period other than either the first ignition and injection time period or the second ignition and injection time period is within the scope of the invention. Alternatively, third ignition and injection time period occurring simultaneously with either the first ignition and injection time period or the second ignition and injection time period is also within the scope of the invention.

During the fourth ignition and injection time period, the fourth one of the ignition and injection switch signal lines 661 provides an ignition and injection switch voltage appearing at the terminal 70 of the ignition and injection switch 66 to the fourth one of the terminals 52 for the ignition and injection power distributor 50-3. The ignition and injection power distributor 50-3 during the fourth ignition and injection time period reroutes the ignition and injection switch voltage appearing at the fourth one of the terminals 52 for the ignition and injection power distributor 50-3 onto a fourth one of the ignition and fuel voltage signal lines 662, whereby the fourth one of the ignition and fuel voltage signal lines 662 supplies the ignition and injection switch voltage to either a spark plug 30 in the fourth one of the cylinders 8 or a fuel injector 32 in the fourth one of the cylinders 8, or both. The fourth ignition and injection time period occurring during a time period other than either the first ignition and injection time period, the second ignition and injection time period, or the third ignition and injection time period is within the scope of the invention.

Alternatively, the fourth ignition and injection time period occurring simultaneously with either the first ignition and injection time period, the second ignition and injection time period, or the third ignition and injection time period is also within the scope of the invention. It should be appreciated that this configuration is not limited to a four-cylinder engine. Instead, this configuration could also be applied to engines having a number of cylinders other than four cylinders.

In an alternative embodiment, the closure of the inlet valve 18 and exhaust valve 20 is accomplished not by the force of a valve spring but by the force of a solenoid (not shown). Preferably, solenoid-actuated valve closure is provided by the substitution of reversible solenoids (not shown) in place of the single action inlet and exhaust solenoids 14, 16, depicted in FIGS. 1H and 1I. Each reversible solenoid is configured to provide pushing force to open a valve as described above, and to provide opposite pulling force to actively close the valve. The delivery of power to reverse the solenoid can be provided at the proper time by switches located at appropriate points along the circumference of the power discs 22, 24, or by any other suitable means known in the art. This active valve closure mechanism is especially useful for high performance engines, wherein spring-actuated valve closure is not sufficiently rapid to close the valves before the piston reaches top dead center. Active valve closure can also produce greater fuel efficiency and lower emissions, because with valves safely out of the path of piston travel, the cylinder head can be contoured to closely fit the piston head. This eliminates trapping of exhaust gasses and allowing more efficient and cleaner burning of fuel.

Active valve closure is associated with the risk of engine damage in the event of sudden failure of the vehicle's electrical system. Such a failure can strand valve heads in open position, extending into the combustion chamber, and, if the pistons continue to cycle by inertial force, they can strike the extended valve heads. This risk can be avoided by the inclusion of an emergency valve closure mechanism. In its simplest form, the emergency valve closure system includes a conventional valve spring (not shown). Alternatively, the emergency valve closure system includes a capacitor circuit (not shown) configured to discharge upon sensing electrical failure of the engine, the discharge powering the reversible solenoid or other valve-closing mechanism to close the valve. Any suitable alternative emergency valve closure mechanism known in the art can also be employed to close the valves in the event of electrical power failure.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that the invention can be practiced otherwise than as specifically described.

What is claimed is:

1. A camless engine operating system comprising:

an inlet valve switch that adjusts a voltage level of an inlet actuator voltage during a rotation of an inlet valve power disc by detecting a first portion of the inlet valve power disc and by detecting a second portion of the inlet valve power disc, an inlet actuator receiving the inlet actuator voltage from the inlet valve switch;

an inlet valve that is movable to open an intake port of a combustion chamber in response to a first inlet valve mechanical force, the inlet valve being movable to close the intake port in response to a second inlet valve mechanical force;

an exhaust valve switch that adjusts a voltage level of an exhaust actuator voltage during a rotation of an exhaust valve power disc by detecting a first portion of the exhaust valve power disc and by detecting a second portion of the exhaust valve power disc, an exhaust actuator receiving the exhaust actuator voltage from the exhaust valve switch; and an exhaust valve that is movable to open an exhaust port of a combustion chamber in response to a first exhaust valve mechanical force, the exhaust valve being movable to close the exhaust port in response to a second exhaust valve mechanical force, wherein the inlet actuator voltage controls the inlet actuator to exert the first inlet valve mechanical force onto the inlet valve during an inlet stroke to open the intake port, the inlet actuator voltage controlling the inlet actuator to exert the second inlet valve mechanical force onto the inlet valve during a time period other than the inlet stroke to close the intake port, wherein the exhaust actuator voltage controls the exhaust actuator to exert the first exhaust valve mechanical force onto the exhaust valve during an exhaust stroke to open the exhaust port, the exhaust actuator voltage controlling the exhaust actuator to exert the second exhaust valve mechanical force onto the exhaust valve during a time period other than the exhaust stroke to close the exhaust port, wherein the exhaust valve power disc is on a disc shaft along with the inlet valve power disc, the inlet valve power disc being coaxial with the exhaust valve power disc.

2. A camless engine operating system according to claim 1, wherein the inlet stroke occurs during the time period other than the exhaust stroke.

3. A camless engine operating system according to claim 1, wherein the inlet valve power disc differs from the exhaust valve power disc, the inlet valve switch differing from the exhaust valve switch.

4. A camless engine operating system according to claim 1, wherein the voltage level of the exhaust actuator voltage is synchronous with the rotation of the exhaust valve power disc, the voltage level of the inlet actuator voltage being synchronous with the rotation of the inlet valve power disc.

5. A camless engine operating system according to claim 1, wherein the rotation of the inlet valve power disc is synchronous with the rotation of the exhaust valve power disc.

6. A camless engine operating system according to claim 1, wherein the inlet actuator is a solenoid and the exhaust actuator is another solenoid.

7. A camless engine operating system according to claim 1, wherein the first portion of the exhaust valve power disc is a conductive portion of the exhaust valve power disc and the second portion of the exhaust valve power disc is a non-conductive portion of the exhaust valve power disc.

8. A camless engine operating system according to claim 1, wherein the first portion of the inlet valve power disc is a conductive portion of the inlet valve power disc and the second portion of the inlet valve power disc is a non-conductive portion of the inlet valve power disc.

9. A camless engine operating system according to claim 1, wherein the inlet valve switch detects the first portion of the inlet valve power disc by touching the first portion of the inlet valve power disc during the rotation of the inlet valve power disc, the inlet valve switch detecting the second portion of the inlet valve power disc by touching the second portion of the inlet valve power disc during the rotation of the inlet valve power disc.

10. A camless engine operating system according to claim 9, wherein the exhaust valve switch detects the first portion of the exhaust valve power disc by touching the first portion of the exhaust valve power disc during the rotation of the exhaust valve power disc, the exhaust valve switch detecting the second portion of the exhaust valve power disc by touching the second portion of the exhaust valve power disc during the rotation of the exhaust valve power disc.

11. A camless engine operating system according to claim 1, further comprising:

a sensor that detects a rotational speed of a signaling disc, the signaling disc being on the disc shaft.

12. A camless engine operating system comprising:

an inlet valve switch that adjusts a voltage level of an inlet actuator voltage during a rotation of an inlet valve power disc by detecting a first portion of the inlet valve power disc and by detecting a second portion of the inlet valve power disc, an inlet actuator receiving the inlet actuator voltage from the inlet valve switch;

an inlet valve that is movable to open an intake port of a combustion chamber in response to a first inlet valve mechanical force, the inlet valve being movable to close the intake port in response to a second inlet valve mechanical force;

an exhaust valve switch that adjusts a voltage level of an exhaust actuator voltage during a rotation of an exhaust valve power disc by detecting a first portion of the exhaust valve power disc and by detecting a second portion of the exhaust valve power disc, an exhaust actuator receiving the exhaust actuator voltage from the exhaust valve switch;

an exhaust valve that is movable to open an exhaust port of a combustion chamber in response to a first exhaust valve mechanical force, the exhaust valve being movable to close the exhaust port in response to a second exhaust valve mechanical force; and an ignition and injection valve switch that adjusts a voltage level of an ignition and injection actuator voltage during a rotation of an ignition and injection valve power disc by detecting a first portion of the ignition and injection valve power disc and by detecting a second portion of the ignition and injection valve power disc, wherein the inlet actuator voltage controls the inlet actuator to exert the first inlet valve mechanical force onto the inlet valve during an inlet stroke to open the intake port, the inlet actuator voltage controlling the inlet actuator to exert the second inlet valve mechanical force onto the inlet valve during a time period other than the inlet stroke to close the intake port, wherein the exhaust actuator voltage controls the exhaust actuator to exert the first exhaust valve mechanical force onto the exhaust valve during an exhaust stroke to open the exhaust port, the exhaust actuator voltage controlling the exhaust actuator to exert the second exhaust valve mechanical force onto the exhaust valve during a time period other than the exhaust stroke to close the exhaust port.

13. A camless engine operating system according to claim 12, wherein a voltage level of the ignition and injection voltage is synchronous with the rotation of the ignition and injection power disc.

14. A camless engine operating system according to claim 12, wherein the ignition and injection valve power disc is coaxial with the exhaust valve power disc.

15. A camless engine operating system according to claim 12, further comprising:

a spark plug that receives the ignition and injection voltage.

16. A camless engine operating system according to claim 12, further comprising:

a fuel injector that receives the ignition and injection voltage.

17. A camless engine operating system comprising:

an inlet valve switch that adjusts a voltage level of an inlet actuator voltage during a rotation of an inlet valve power disc by detecting a first portion of the inlet valve power disc and by detecting a second portion of the inlet valve power disc, an inlet actuator receiving the inlet actuator voltage from the inlet valve switch;

an inlet valve that is movable to open an intake port of a combustion chamber in response to a first inlet valve mechanical force, the inlet valve being movable to close the intake port in response to a second inlet valve mechanical force;

an exhaust valve switch that adjusts a voltage level of an exhaust actuator voltage during a rotation of an exhaust valve power disc by detecting a first portion of the exhaust valve power disc and by detecting a second portion of the exhaust valve power disc, an exhaust actuator receiving the exhaust actuator voltage from the exhaust valve switch;

an exhaust valve that is movable to open an exhaust port of a combustion chamber in response to a first exhaust valve mechanical force, the exhaust valve being movable to close the exhaust port in response to a second exhaust valve mechanical force; and an all-time exhaust valve switch that adjusts a voltage level of an all-time exhaust actuator voltage during a rotation of an all-time exhaust valve power disc by detecting a first portion of the all-time exhaust valve power disc and by detecting a second portion of the all-time exhaust valve power disc, wherein the inlet actuator voltage controls the inlet actuator to exert the first inlet valve mechanical force onto the inlet valve during an inlet stroke to open the intake port, the inlet actuator voltage controlling the inlet actuator to exert the second inlet valve mechanical force onto the inlet valve during a time period other than the inlet stroke to close the intake port, wherein the exhaust actuator voltage controls the exhaust actuator to exert the first exhaust valve mechanical force onto the exhaust valve during an exhaust stroke to open the exhaust port, the exhaust actuator voltage controlling the exhaust actuator to exert the second exhaust valve mechanical force onto the exhaust valve during a time period other than the exhaust stroke to close the exhaust port.

18. A camless engine operating system according to claim 17, wherein the exhaust valve is movable in response to a first all-time exhaust valve mechanical force to open the exhaust port of the combustion chamber during an all-time exhaust stroke of the combustion cycle and is movable to in response to a second all-time exhaust valve mechanical force close the exhaust port during a time period other than the all-time exhaust stroke.

19. A camless engine operating system according to claim 17, wherein a voltage level of the all-time exhaust actuator voltage is synchronous with the rotation of the all-time exhaust valve power disc.

* * * * *